US005945375A

United States Patent [19]

Kronzer

[11] Patent Number: 5,945,375

[45] Date of Patent: Aug. 31, 1999

[54] THERMAL DYE DIFFUSION COATING AND SUBSTRATE

[75] Inventor: Francis Joseph Kronzer, Alpharetta, Ga.

[73] Assignee: Kimberly-Clark Worldwide, Inc., Neenah, Wis.

[21] Appl. No.: 09/027,515

[22] Filed: Feb. 20, 1998

Related U.S. Application Data

[60] Provisional application No. 60/043,040, Mar. 31, 1997, and provisional application No. 60/043,203, Apr. 8, 1997.

[51] Int. Cl.[6] ..... B41M 5/035; B41M 5/38

[52] U.S. Cl. ..... 503/227; 428/195; 428/212; 428/323; 428/913; 428/914

[58] Field of Search ..... 8/471; 428/195, 428/212, 323, 913, 914; 503/227; 524/293

[56] References Cited

U.S. PATENT DOCUMENTS

| | | | |
|---|---|---|---|
| 3,898,086 | 8/1975 | Franer et al. | 96/28 |
| 3,975,563 | 8/1976 | Franer et al. | 428/143 |
| 4,018,728 | 4/1977 | Priest | 260/17 R |
| 4,068,033 | 1/1978 | Meade | 428/201 |
| 4,117,182 | 9/1978 | Andrews | 428/201 |
| 4,259,225 | 3/1981 | Saito et al. | 260/31.8 |
| 4,299,899 | 11/1981 | Azar et al. | 430/108 |
| 4,303,717 | 12/1981 | Andrews | 428/200 |
| 4,472,537 | 9/1984 | Johnson et al. | 523/160 |
| 4,605,694 | 8/1986 | Walker | 524/292 |
| 4,620,026 | 10/1986 | Siegel | 560/85 |
| 4,950,702 | 8/1990 | Arendt | 524/292 |
| 5,026,756 | 6/1991 | Arendt | 524/293 |
| 5,091,454 | 2/1992 | Arendt | 524/293 |
| 5,169,889 | 12/1992 | Kauffman et al. | 524/270 |
| 5,239,314 | 8/1993 | Abber et al. | 346/135.1 |
| 5,242,739 | 9/1993 | Kronzer et al. | 428/200 |
| 5,252,393 | 10/1993 | Kagota et al. | 428/349 |
| 5,252,646 | 10/1993 | Iovine et al. | 524/270 |
| 5,256,717 | 10/1993 | Stauffer et al. | 524/293 |
| 5,312,850 | 5/1994 | Iovine et al. | 524/47 |
| 5,354,368 | 10/1994 | Larson, Jr. | 106/22 A |
| 5,356,963 | 10/1994 | Kauffman et al. | 524/43 |
| 5,534,575 | 7/1996 | Foster et al. | 524/270 |
| 5,565,246 | 10/1996 | Hyde | 427/504 |

FOREIGN PATENT DOCUMENTS

| | | | |
|---|---|---|---|
| 469564 A1 | 2/1992 | European Pat. Off. | B29B 13/02 |
| 523511 A1 | 1/1993 | European Pat. Off. | B41M 5/00 |
| 699800 A2 | 3/1996 | European Pat. Off. | D21H 19/28 |

OTHER PUBLICATIONS

"Dye Diffusion Thermal Transfer, Dependence of Print Performance on Dye Structure", R.A. Hann and N.C. Beck, 7th International Congress on Advances in NIP Technologies, (1991), 237–246 (Abstract).

"Thermal Dye Diffusion Printing–How Does It Work?", R. A. Hann, 8th International Congress on Advances in NIP Technologies, (1992), 361–363.

*Primary Examiner*—Bruce H. Hess
*Attorney, Agent, or Firm*—William E. Maycock

[57] ABSTRACT

A coating suitable for receiving an image by dye diffusion printing which includes a thermoplastic polymer having a glass transition temperature of at least about 30° C. and a powdered plasticizer having a melting point of at least about 80° C. The thermoplastic polymer may have a glass transition temperature of at least about 40° C. For example, the thermoplastic polymer may be a vinyl chloride-acrylate copolymer. The plasticizer may be an aromatic carboxylic acid ester, such as cyclohexane dimethanol dibenzoate. The average particle size of the powdered plasticizer may be no greater than about 20 micrometers. The weight ratio of the thermoplastic polymer to the plasticizer typically is in a range of from about 80:20 to about 40:60. Finally, the coating includes a release agent. The release agent may be present in a range of from about 0.5 to about 10 percent by weight, based on the weight of dry coating. The present invention also provides a coated substrate suitable for receiving an image by dye diffusion printing and a coating composition which is an aqueous dispersion of a thermoplastic polymer having a glass transition temperature of at least about 30° C., a powdered plasticizer having a melting point of at least about 80° C., and a release agent.

13 Claims, No Drawings

THERMAL DYE DIFFUSION COATING AND SUBSTRATE

This application claims the benefit of U.S. Provisional Application Ser. No. 60/043,040, filed on Mar. 31, 1997, and U.S. Provisional Application Ser. No. 60/043,203, filed on Apr. 8, 1997.

BACKGROUND OF THE INVENTION

The present invention relates to thermal dye diffusion printing.

Thermal dye diffusion printing is a non-impact electronic printing process which is capable of giving near photographic quality prints. An image is formed by using a thermal head to transfer dye from a color ribbon into a surface of a receiver. The head consists of a line of individually addressable heated elements which are fed appropriate electrical pulses to generate the quantity of heat required to provide the amount of dye transfer needed to reproduce the corresponding pixel in the image. The surface temperature of the thermal head typically is 350° C. and the duration of the heating pulse typically is up to 10 milliseconds. The depth of shade is governed by the length of the heating pulse and a full color image is built up in the normal way by transfer of the primary colors on top of each other.

In general, both the ribbon and the receiver have very smooth surfaces. The active layer of the ribbon consists of a solid solution of dye in a binder. The receiver typically consists of a polymer coating on a paper or other supporting material; the coating is designed to be receptive to the dye and to release smoothly from the ribbon, or dye layer, after printing.

The receiver is supported on a platen roller and the thermal head is pressed against the surface of the ribbon. The two media are held together under a pressure of between 10 and 100 atmospheres. As the surfaces are very smooth, there is no air gap between the media in the region where the thermal head is applying maximum pressure. Dye is transferred by phase transfer and diffusion; the dye which is dissolved in the dye layer partitions into the receiver coating by a molecular diffusion process. Once dye is in the receiver coating, it is free to continue diffusing further into the coating as long as the thermal head temperature remains sufficiently high. At all stages, the dye molecules are surrounded by a polymer matrix; transfer occurs from one polymer phase to another without sublimation taking place.

Because the dyes are always constrained by polymer molecules, the dye diffusion process is very well controlled. The build up of color is well defined and sideways diffusion cannot occur, as is possible in the air gap of a sublimation process.

While films have the requisite degree of smoothness, the accumulation of a static charge on the film may occur during the printing process which leads to the attraction of dust particles on the surfaces of the film. The presence of dust on a receiver coating prevents intimate contact over the entire area of the thermal printing head which results in imperfections in the printed image. While papers generally do not suffer from static charge build up, image quality may be reduced. In addition, transfer of the printed image to another substrate may be adversely affected by the use of a paper carrier or support for the receiver coating. Accordingly, there is a need for improved thermal dye diffusion substrates, particularly for substrates intended to be used as a heat transfer material.

SUMMARY OF THE INVENTION

The present invention addresses some of the difficulties and problems discussed above by providing a coating suitable for receiving an image by dye diffusion printing. The coating includes a thermoplastic polymer having a glass transition temperature of at least about 30° C. For example, the thermoplastic polymer may have a glass transition temperature of at least about 400° C. As another example, the thermoplastic polymer may be a vinyl chloride-acrylate copolymer.

The coating also includes a powdered plasticizer having a melting point of at least about 80° C. For example, the plasticizer may be an aromatic carboxylic acid ester. As another example, the plasticizer may be cyclohexane dimethanol dibenzoate. As a further example, the average particle size of the powdered plasticizer may be no greater than about 20 micrometers. The weight ratio of the thermoplastic polymer to the plasticizer typically is in a range of from about 80:20 to about 40:60. For example, the weight ratio of the thermoplastic polymer to the plasticizer may be from about 70:30 to about 50:50.

Finally, the coating includes a release agent. The release agent may be present in a range of from about 0.5 to about 10 percent by weight, based on the dry weight of the coating.

The present invention also provides a coated substrate suitable for receiving an image by dye diffusion printing. The coated substrate includes a flexible first layer which has first and second surfaces and is selected from the group consisting of films, fibrous sheet-like materials, and combinations thereof. For example, the first layer may be a film. As another example, the first layer may be a fibrous sheet-like material.

The present invention further provides a coated substrate suitable for receiving an image by dye diffusion printing which includes a flexible first layer as just described; a second layer overlaying the first surface of the first layer, which second layer comprises a first thermoplastic polymer having a glass transition temperature of at least about 30° C. and a first powdered plasticizer having a melting point of at least about 80° C.; and a third layer overlaying the second layer, which third layer includes a second thermoplastic polymer having a glass transition temperature of at least about 30° C., a second powdered plasticizer having a melting point of at least about 80° C., and a release agent.

The first layer has a basis weight of from about 50 to about 200 grams per square meter. For example, the first layer may be a film. As a further example, the first layer may a fibrous sheet-like material. The second layer has a basis weight of from about 0.5 to about 10 grams per square meter, and the third layer has a basis weight of from about 0.5 to about 10 grams per square meter.

The weight ratio of first thermoplastic polymer to first plasticizer is in a range of from about 80:20 to about 40:60 and the weight ratio of second thermoplastic polymer to second plasticizer is in a range of from about 80:20 to about 40:60. The release agent is present in the third layer in a range of from about 0.5 to about 10 percent by weight, based on the weight of the third layer coating.

By way of illustration only, the first thermoplastic polymer may have a glass transition temperature of at least about 40° C. For example, the first thermoplastic polymer may be a vinyl chloride-acrylate copolymer. Similarly, the second thermoplastic polymer may have a glass transition temperature of at least about 40° C. and may be a vinyl chloride-acrylate copolymer. The first powdered plasticizer may be an aromatic carboxylic acid ester, such as cyclohexane dimethanol dibenzoate. The average particle size of the first powdered plasticizer may be, for example, no greater than about 20 micrometers. In like manner, the second powdered plasticizer may an aromatic carboxylic acid ester, such as cyclohexane dimethanol dibenzoate and may have an average particle size no greater than about 20 micrometers.

Finally, the present invention provides a coating composition which is an aqueous dispersion of a thermoplastic polymer having a glass transition temperature of at least about 30° C., a powdered plasticizer having a melting point of at least about 80° C., and a release agent. The weight ratio of thermoplastic polymer to powdered plasticizer is in a range of from about 80:20 to about 40:60, on a dry weight basis, and the release agent is present in a range of from about 0.5 to about 10 percent by weight, on a dry weight basis, based on the weight of the solids content. The aqueous dispersion contains from about 10 to about 50 percent by weight solids.

By way of example, the thermoplastic polymer may have a glass transition temperature of at least about 40° C. As another example, the thermoplastic polymer may be a vinyl chloride-acrylate copolymer. As a further example, the powdered plasticizer may be an aromatic carboxylic acid ester, such as cyclohexane dimethanol dibenzoate. As a further example, the average particle size of the powdered plasticizer may be no greater than about 20 micrometers.

DETAILED DESCRIPTION OF THE INVENTION

As used herein, the term "fibrous sheet-like material" is meant to include any fibrous material which typically is prepared by air laying or wet laying relatively short fibers to form a nonwoven web or sheet. Thus, the term includes nonwoven webs prepared from a papermaking furnish. Such furnish may include, by way of illustration, only cellulose fibers, a mixture of cellulosic fibers and noncellulosic fibers, or only noncellulosic fibers. When the furnish contains only cellulosic fibers or a mixture of cellulosic fibers and noncellulosic fibers, the resulting web is referred to herein as a "cellulosic nonwoven web." Noncellulosic fibers include, by way of illustration only, glass wool and fibers prepared from thermosetting and thermoplastic polymers, as is well known to those having ordinary skill in the art. Of course, the cellulosic nonwoven web also may contain additives and other materials, such as fillers, e.g., clay and titanium dioxide, as is well known in the papermaking art. Desirably, the fibrous sheet-like material will be composed of synthetic thermoplastic fibers, examples of which materials are the Kimdura® synthetic papers manufactured by Oji-Yuka Paper Company of Japan. Such materials have desirably smooth surfaces and handle more like paper than films. In addition, such synthetic papers are readily available and more pliable and exhibit a reduced tendency for static build-up which attracts dust. Dust on the coating causes print voids since dye diffusion ribbon printers require intimate contact between the substrate and the ribbon for proper dye transfer.

In general, the term "cellulosic fibers" is meant to include cellulosic fibers from any source. Sources of cellulosic fibers include, by way of illustration only, woods, such as softwoods and hardwoods; straws and grasses, such as rice, esparto, wheat, rye, and sabai; bamboos; jute; flax; kenaf; cannabis; linen; ramie; abaca; sisal; and cotton and cotton linters. Softwoods and hardwoods are the more commonly used sources of cellulosic fibers. In addition, the cellulosic fibers may be obtained by any of the commonly used pulping processes, such as mechanical, chemimechanical, semichemical, and chemical processes. For example, softwood and hardwood Kraft pulps are desirable for toughness and tear strength, but other pulps, such as recycled fibers, sulfite pulp, and the like may be used, depending upon the application.

The phrase "weight ratio of the thermoplastic polymer to the plasticizer" refers to the parts by weight of thermoplastic polymer and plasticizer per 100 parts by weight of both components, separated by a colon, such as 80:20 or 40:60. The weight ratio also may be expressed as a fraction, e.g., 80/20 or 40/60. Thus, the ratio 80:20 (or 80/20) is equivalent to 4 parts by weight of thermoplastic polymer for each part by weight of plasticizer.

The term "thermoplastic polymer having a glass transition temperature of at least about 30° C." is intended to include any thermoplastic polymer which meets the stated glass transition temperature requirement. Examples of such thermoplastic polymers include, by way of illustration only, poly(acrylonitrile); poly(methacrylonitrile); poly(vinyl chloride); poly(acrylic acid); poly(methacrylic acid); a poly(acrylate), such as poly(4-biphenylyl acrylate), poly(2-t-butylphenyl acrylate), poly[3-chloro-2,2-bis(chloromethyl) propyl acrylate], poly(4-chlorophenyl acrylate), poly(pentachlorophenyl acrylate), poly(2-ethoxycarbonylphenyl acrylate), poly(2-heptyl acrylate), poly(hexadecyl acrylate), poly(3-methoxycarbonylphenyl acrylate), poly(4-methoxyphenyl acrylate), poly(3,5-dimethyladamantyl acrylate), poly(3-dimethylaminophenyl acrylate), poly(2-naphthyl acrylate), poly(phenyl acrylate), poly(o-tolyl acrylate), poly(methyl methacrylate), poly(benzyl methacrylate), poly(2-bromoethyl methacrylate), poly(2-t-butylaminoethyl methacrylate), poly(sec-butyl methacrylate), atactic and syndiotactic poly(t-butyl methacrylate), poly(2-chloroethyl methacrylate), poly(cyclohexyl methacrylate), poly(t-butylcyclohexyl methacrylate), atactic and syndiotactic poly(ethyl methacrylate), poly(2-hydroxyethyl methacrylate), atactic and syndiotactic poly(isopropyl methacrylate), poly(ethyl chloroacrylate), and poly(ethyl fluoromethacrylate); a poly(acrylamide), such as poly(acrylamide), poly(N-butylacrylamide), poly(N-sec-butylacrylamide), poly(N-t-butylacrylamide), poly(N,N-dibutylacrylamide), poly(isodecylacrylamide), poly(isohexyacrylamide), poly(isononylacrylamide), poly(isooctylacrylamide), poly(N-isopropylacrylamide), poly(N,N-diisopropylacrylamide), poly(N,N-dimethylacrylamide), poly[N-(1-methylbutyl) acrylamide], poly(N-methyl-N-phenylacrylamide), poly(morpholylacrylamide), poly(N-octylacrylamide), and poly(4-ethoxycarbonylphenylmethacrylamide); a poly(styrene), such as poly(styrene), poly(4-acetylstyrene), poly(5-bromo-2-methoxystyrene), poly(4-butoxycarbonylstyrene), poly(3-chlorostyrene), poly(2-ethylestyrene), poly(4-methoxystyrene), and poly(3-methylstyrene); a poly(ester), such as poly(ethylene terephthalate), and poly(trimethylene terephthalate); a poly(substituted ethylene), such as poly(t-butylethylene), atactic and isotactic poly(cyclohexylethylene), poly(2-cyclohexylethylene), poly[(cyclohexylmethyl)ethylene], poly(cyclopentylethylene), poly[(cyclopentylmethyl)ethylene], poly-(hexyldecylethylene), poly(isobutylethylene), atactic and isotactic poly(isopropyl-ethylene), poly(3,3-dimethylbutylethylene), poly-(1,1,2-trimethyltrimethylene), poly(4,4-dimethylpentylethylene), poly(neopentylethylene), poly(t-butoxyethylene), poly(cylohexyloxyethylene), poly(2-methoxypropylene), poly(benzoylethylene), poly(1,2-difluoroethylene), poly(3-chlorobenzoyloxyethylene); a poly(phenylene), such as poly(2-methyl-1,4-phenyleneethylene), and poly(2-chloro-1,4-phenyleneethylene); a poly(oxide), such as poly(oxy-t-butylethylene), poly(oxy-1,4-phenylene), and poly (oxyphenylethylene); a poly(amide), such as poly (iminopentamethyleneiminoadipoyl) (or nylon 5,6), poly (imino-1-oxo-hexamethylene) (or nylon 6), poly (iminoadipoyliminohexamethylene) or (nylon 6,6), and poly (iminohexamethyleneiminododecanedioyl) (or nylon 6,12).

As used herein, the term "acrylate" is meant to include any ester of acrylic acid or a substituted acrylic acid, such as methacrylic acid. For example, the acrylate may be one which is particularly well suited for use in the preparation of a copolymer in which one component is vinyl chloride. The term also is meant to include a single acrylate or two or more acrylates. In an analogous manner, the term "poly(acrylic acid)" is meant to include polymers of acrylic acid or a substituted acrylic acid, such as methacrylic acid.

In accordance with the present invention, there is provided a coating suitable for receiving an image by dye diffusion printing. The coating includes a thermoplastic polymer having a glass transition temperature of at least about 30° C. For example, the thermoplastic polymer may have a glass transition temperature of at least about 40° C. As another example, the thermoplastic polymer may be a vinyl chloride-acrylate copolymer.

The coating also includes a powdered plasticizer having a melting point of at least about 80° C. In general, the plasticizer may be any plasticizer which is appropriate for the thermoplastic polymer. By way of example, when the thermoplastic polymer is a vinyl chloride-acrylate copolymer, the plasticizer may be an aromatic carboxylic acid ester. As a further example, the plasticizer may be a benzoate. As another example, the plasticizer may be cyclohexane dimethanol dibenzoate.

Desirably, the average particle size of the powdered plasticizer will be no greater than about 20 micrometers. This allows the powdered plasticizer to be readily dispersed in an aqueous medium, such as an aqueous dispersion of the thermoplastic polymer. For example, the average particle size of the powdered plasticizer may be no greater than about 15 micrometers.

The weight ratio of the thermoplastic polymer to the plasticizer typically is in a range of from about 80:20 to about 60:40. For example, the weight ratio of the thermoplastic polymer to the plasticizer may be from about 70:30 to about 50:50.

Finally, the coating includes a release agent. The release agent may be present in a range of from about 0.5 to about 10 percent by weight, based on the total weight of the coating.

The present invention also provides a coated substrate suitable for receiving an image by dye diffusion printing. The coated substrate includes a flexible first layer which has first and second surfaces and is selected from the group consisting of films, fibrous sheet-like materials, and combinations thereof. For example, the first layer may be a film. As another example, the first layer may be a fibrous sheet-like material.

The present invention further provides a coated substrate suitable for receiving an image by dye diffusion printing which includes a flexible first layer as just described; a second layer overlaying the first surface of the first layer, which second layer comprises a first thermoplastic polymer having a glass transition temperature of at least about 30° C. and a first powdered plasticizer having a melting point of at least about 80° C.; and a third layer overlaying the second layer, which third layer includes a second thermoplastic polymer having a glass transition temperature of at least about 30° C., a second powdered plasticizer having a melting point of at least about 80° C., and a release agent.

The first layer has a basis weight of from about 50 to about 200 grams per square meter. For example, the first layer may be a film. As a further example, the first layer may a fibrous sheet-like material. The second layer has a basis weight of from about 0.5 to about 10 grams per square meter, and the third layer has a basis weight of from about 0.5 to about 10 grams per square meter.

The weight ratio of first thermoplastic polymer to first plasticizer is in a range of from about 80:20 to about 40:60 and the weight ratio of second thermoplastic polymer to second plasticizer is in a range of from about 80:20 to about 40:60. The release agent is present in the third layer in a range of from about 0.5 to about 10 percent by weight, based on the weight of the third layer.

By way of illustration only, the first thermoplastic polymer may have a glass transition temperature of at least about 40° C. For example, the first thermoplastic polymer may be a vinyl chloride-acrylate copolymer. Similarly, the second thermoplastic polymer may have a glass transition temperature of at least about 40° C. and may be a vinyl chloride-acrylate copolymer. The first powdered plasticizer may be an aromatic carboxylic acid ester, such as cyclohexane dimethanol dibenzoate. The average particle size of the first powdered plasticizer may be, for example, no greater than about 20 micrometers. In like manner, the second powdered plasticizer may an aromatic carboxylic acid ester, such as cyclohexane dimethanol dibenzoate and may have an average particle size no greater than about 20 micrometers.

Finally, the present invention provides a coating composition which is an aqueous dispersion of a thermoplastic polymer having a glass transition temperature of at least about 30° C., a powdered plasticizer having a melting point of at least about 80° C., and a release agent. The weight ratio of thermoplastic polymer to powdered plasticizer is in a range of from about 80:20 to about 40:60, on a dry weight basis, and the release agent is present in a range of from about 0.5 to about 10 percent by weight, on a dry weight basis, based on the weight of coating solids. The aqueous dispersion contains from about 10 to about 50 percent by weight solids.

By way of example, the thermoplastic polymer may have a glass transition temperature of at least about 40° C. As another example, the thermoplastic polymer may be a vinyl chloride-acrylate copolymer. As a further example, the powdered plasticizer may be an aromatic carboxylic acid ester, such as cyclohexane dimethanol dibenzoate. As a further example, the average particle size of the powdered plasticizer may be no greater than about 20 micrometers.

The present invention is further described by the examples which follow. Such examples, however, are not to be construed as limiting in any way either the spirit or the scope of the present invention.

EXAMPLES

The substrates employed in the examples were Kimdura® FPG-150 synthetic paper from Oji-Yuka Paper Company, a 4-mil, white opaque polyester film (Grade 339/380 from Imperial Chemical Industries of Great Britain), and another synthetic paper, Kimdura® QBZ 180. These are referred to hereinafter as Substrates 1, 2 and 3, respectively (or S-1, S-2, and S-3).

Several different coating compositions also were utilized. These are identified below.

Coating Composition 1 (C-1)

This coating composition was a 50/50 blend on a dry weight basis of Vycar® 352 and Benzoflex® 352. Vycar® 352 is a 56 percent total solids latex dispersion of a vinyl chloride-acrylate copolymer having a glass transition temperature of 69° C. (B. F. Goodrich Company, Cleveland Ohio). Benzoflex® 352 is cyclohexane dimethanol dibenzoate from Velsicol Chemical Corp. ( ). The flake form of the material was ground to an average particle size of 10 micrometers. In this form it dispersed easily in water containing 3 parts on a dry weight basis of a polyethoxylated octylphenol, Triton X-100 (Rohm and Haas Company, Philadelphia, Pa.) per 100 parts of the Benzoflex® 352; the resulting dispersion contained 33 percent solids.

Coating Composition 2 (C-2)

Coating Composition 2 was a 46.5/46.5/7 blend on a dry weight basis of Vycar® 352, Benzoflex® 352, and Dow Corning 190 silicone, a release agent.

Coating Composition 3 (C-3)

Coating Composition 3 was a 62/31/7 blend on a dry weight basis of Vycar® 352, Benzoflex® 352, and Dow Corning 190 silicone.

Coating Composition 4 (C-4)

This coating composition consisted of Michem® Prime 4983.

Coating Composition 5 (C-5)

This coating composition was a 100/50/25/10/5 blend of Vycar® 352, Kronitex® 100, Michem® Prime 4983, calcium stearate (Nopcote® C-104, Henkle Corporation, Ambler, Pa.)), and Xama® 7. Kronitex® 100 is an aryl phosphate liquid plasticizer (FMC Corporation). Xama® 7 is a multifunctional aziridine crosslinker (Sancor Industries, Leomaster, Mass.).

A substrate was coated with one or more coatings, by means of a Meyer rod, with drying between coats as necessary. The resulting materials are summarized in Table 1.

TABLE 1

Summary of Dye Diffusion Substrates

| | | 1st Coating | | 2nd Coating | | 3rd Coating | |
|---|---|---|---|---|---|---|---|
| Ex. | Substrate | Code | Wt.[a] | Code | Wt.[a] | Code | Wt.[a] |
| 1 | A | C-1 | 2.0 | N/P[b] | N/P | N/P | N/P |
| 2 | A | C-2 | 2.0 | N/P | N/P | N/P | N/P |
| 3 | A | C-1 | 2.0 | C-2 | 2.0 | N/P | N/P |
| 4 | A | C-1 | 2.0 | C-3 | 2.0 | N/P | N/P |
| 5 | A | C-1 | 2.0 | C-3 | 2.8 | N/P | N/P |
| 6 | A | C-4 | 6.0 | C-1 | 2.0 | C-3 | 2.8 |
| 7 | B | C-1 | 2.0 | C-3 | 2.8 | N/P | N/P |
| 8 | C | C-5 | 2.5 | N/P | N/P | N/P | N/P |

[a]Coating weight in grams per square meter.
[b]Not present.

Each substrate was printed with a multicolored test pattern with three or more color gradations in each color. The resulting patterns were cut into approximately 3-inch by 2-inch (about 7.6-cm×about 5-cm) rectangles and taped to laser mugs from RPL. The mug press used was the RPL model. Transfer to the mugs was carried out at 275° F. (about 135° C.) for three minutes, except for Example 7. The printing and mug transfer results are summarized in Table 2.

TABLE 2

Printing and Mug Transfer Results

| Example | Print Test | Transfer Test |
|---|---|---|
| 1 | Dark printing, ribbon sticking | Good transfer, mug sticking; film left on mug |
| 2 | Coating removed from substrate (poor adhesion) | |
| 3 | Good, dark print | Excellent |
| 4 | Very good - slightly grainy | Very good |
| 5 | Very good - slightly grainy | Very good |
| 6 | Excellent | Fair, lighter than Examples 5 & 9 |
| 7 | Fair - voids due to dust | Good (204° C., 1 minute) |
| 8 | Yellowing in light areas, ribbon smudges in nonprint areas | Poor |

The utility of a release agent in a single coating was demonstrated by Examples 1 and 2, even though the coating had not been optimized. Examples 3–5 showed the improved results which may be obtained with two coatings, in which the first coating did not contain a release agent. Three coatings may be employed, if desired, as shown by Example 6; the first coating in this example was a primer, which provides better print quality. The problem caused by static charge accumulation with a film was illustrated by Example 7, although printing and transferring of the printed image were otherwise good.

The excellent mug transfer results at only 135° C. were very surprising, as were the very good to excellent dark prints. The results seen with Example 8 were more typical of prior art materials. The transfer material used in that example generally is not suitable for mug transfers because of ink smudging and poor transfer of the image to the mug.

Also surprising was the ease of making water-based coatings using the fine, powdered plasticizer as described in the examples. Liquid plasticizers give problems in making stable coatings and using the coatings made therewith.

While the specification has been described in detail with respect to specific embodiments thereof, it will be appreciated by those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A coated substrate suitable for receiving an image by dye diffusion printing comprising:

a flexible first layer having first and second surfaces and selected from the group consisting of films, fibrous materials, and combinations thereof;

a second layer overlaying the first surface of the first layer, which second layer comprises a first thermoplastic polymer having a glass transition temperature of at least about 30° C. and a first powdered plasticizer having a melting point of at least about 80° C.; and a third layer overlaying the second layer, which third layer comprises a second thermoplastic polymer having a glass transition temperature of at least about 30° C., a second powdered plasticizer having a melting point of at least about 80° C., and a release agent; wherein:

the first layer has a basis weight of from about 50 to about 200 grams per square meter;

the second layer has a basis weight of from about 0.5 to about 10 grams per square meter;

the third layer has a basis weight of from about 0.5 to about 10 grams per square meter;

the weight ratio of first thermoplastic polymer to first powdered plasticizer is in a range of from about 80:20 to about 40:60;

the weight ratio of second thermoplastic polymer to second powdered plasticizer is in a range of from about 80:20 to about 40:60; and the release agent is present in the third layer in a range of from about 0.5 to about 10 percent by weight, based on the weight of the third layer.

2. The coated substrate of claim 1, in which the first thermoplastic polymer has a glass transition temperature of at least about 40° C.

3. The coated substrate of claim 2, in which the first thermoplastic polymer is a vinyl chloride-acrylate copolymer.

4. The coated substrate of claim 1, in which the second thermoplastic polymer has a glass transition temperature of at least about 40° C.

5. The coated substrate of claim 4, in which the second thermoplastic polymer is a vinyl chloride-acrylate copolymer.

6. The coating of claim 1, in which the first powdered plasticizer is an aromatic carboxylic acid ester.

7. The coating of claim 6, in which the first powdered plasticizer is cyclohexane dimethanol dibenzoate.

8. The coated substrate of claim 1, in which the average particle size of the first powdered plasticizer is no greater than about 20 micrometers.

9. The coating of claim 1, in which the second powdered plasticizer is an aromatic carboxylic acid ester.

10. The coating of claim 9, in which the second powdered plasticizer is cyclohexane dimethanol dibenzoate.

11. The coated substrate of claim 1, in which the average particle size of the second powdered plasticizer is no greater than about 20 micrometers.

12. The coated substrate of claim 1, in which the first layer is a film.

13. The coated substrate of claim 1, in which the first layer is a fibrous material.

* * * * *

UNITED STATES PATENT AND TRADEMARK OFFICE

CERTIFICATION OF CORRECTION

PATENT NO. : 5,945,375

DATED : August 31, 1999

INVENTOR(S): Francis Joseph Kronzer

It is certified that error appears in the above-identified patent and that said Letters Patent is hereby corrected as shown below:

Column 6, line 30, "may an aromatic" should read --may be an aromatic--;
Column 8, line 13, "5 & 9" should read --5 & 7--.

Signed and Sealed this

Thirteenth Day of June, 2000

*Attest:*

Q. TODD DICKINSON

*Attesting Officer*

*Director of Patents and Trademarks*